US006062051A

United States Patent [19]

Nam et al.

[11] Patent Number: 6,062,051

[45] **Date of Patent: *May 16, 2000**

[54] DIAL LOCK SLIDE FOR A SLIDE FASTENER

[76] Inventors: Du Hyun Nam; Jung Hee Kim, both of 1-tong 3-ban, 97-20 Ho, Songpa-dong, Songpa-ku, Seoul 100210, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,832

[22] PCT Filed: Sep. 17, 1994

[86] PCT No.: PCT/KR94/00126

§ 371 Date: May 17, 1996

§ 102(e) Date: May 17, 1996

[87] PCT Pub. No.: WO95/08280

PCT Pub. Date: Mar. 30, 1995

[30] Foreign Application Priority Data

Sep. 18, 1993 [KR] Rep. of Korea ..... 93/18966

[51] Int. Cl.[7] ..... E05B 67/38; E05B 37/02

[52] U.S. Cl. ..... 70/68; 70/58; 70/312; 70/315

[58] Field of Search ..... 70/68, 287, 288, 70/304, DIG. 44, 382, 385, 312–315; 411/303, 432

[56] References Cited

U.S. PATENT DOCUMENTS

| | | | |
|---|---|---|---|
| 244,256 | 7/1881 | Kendall | 411/303 |
| 1,196,218 | 8/1916 | Drapalik | 70/304 |
| 1,583,635 | 5/1926 | Wildrick | 70/304 |
| 2,741,114 | 4/1956 | Poux | 70/287 |
| 3,210,971 | 10/1965 | VanDamme | 70/68 |
| 3,237,435 | 3/1966 | Paul | 70/315 |
| 3,691,328 | 9/1972 | Davidson | 200/43 |
| 4,008,914 | 2/1977 | Anderson | 292/307 R |
| 4,081,882 | 4/1978 | Toepelt et al. | 24/205 R |
| 4,123,829 | 11/1978 | Takabatake . | |
| 4,350,375 | 9/1982 | Bako . | |
| 4,519,229 | 5/1985 | Yang | 70/312 |
| 4,524,592 | 6/1985 | Saitoh | 70/287 |
| 4,669,285 | 6/1987 | Kim | 70/312 |
| 5,031,944 | 7/1991 | Keyaki | 292/307 R |
| 5,063,760 | 11/1991 | Horita et al. | 70/23 |
| 5,063,761 | 11/1991 | Ling | 70/25 |
| 5,653,136 | 8/1997 | Huang | 70/312 |

FOREIGN PATENT DOCUMENTS

| | | | |
|---|---|---|---|
| 1093599 | 5/1955 | France | 70/287 |
| 404782 | 1/1934 | United Kingdom | 70/68 |
| 413825 | 7/1934 | United Kingdom | 70/68 |

*Primary Examiner*—Teri Pham
*Attorney, Agent, or Firm*—Birch, Stewart, Kolasch & Birch, LLP

[57] ABSTRACT

The present invention relates to a dial lock slide for slide fasteners used for bags or trunks, made capable of altering the dial code at will that opening the lock may become impossible for others, through its characteristic construction, wherein a slide (1) on one side has a lock bar (13) which has key (14) in projection, while another slide (2) on the other side has a cylinder (23) which has slit (23*a*); cylinder (23) is inserted, keeping said lock devices (30) rotatable; and a lock ring (41) with a polygonal outer surface (42) corresponding to a polygonal inner surface (33) of an inward-turning flange (32) and also inner key grooves (43) is inserted, rotatably, in a dial ring (31), which has said inward-turning flange (32) and a polygonal inner surface (33) on one side.

4 Claims, 5 Drawing Sheets

DIAL LOCK SLIDE FOR A SLIDE FASTENER

BACKGROUND OF THE INVENTION

The present invention relates to a dial lock slides for a slide fastener of a bag, a trunk, etc., and, especially, to one for a slide fastener so manufactured as to prevent theft by enabling the carrier to alter the dial code at will.

The locking device of prior arts is so made, as is seen in FIG. 7, that a slide 91 on one side and another slide 92 on the other side are slid toward each other, a pair of rows of elements (not shown in the drawing) are joined and a handle 93 connected with the lug 92*a* of said slide 92 on one side is turned, while a lever 93*a* is kept pressed down, so that a lug 91*a* of said slide 91 may be inserted in a lock groove 93*b* of said handle 93, and said lever 93*a* is released, whereupon said handle 93 and said slide 91 are joined by means of a lock member 93*c*, and this state a key cylinder 93*d* of said handle 93 is turned by a key to fix said lock member 93*c*.

But in a locking device for a slide fastener of prior arts it is found pretty easy to open the lock by the use of a key not quite fitting the key cylinder 93*d*, and thus the practicability of such a locking device is quite insignificant, and, for a serious disadvantage, it is impossible to apply such a device for of prior arts to a slide fastener with more than three slides.

SUMMARY OF THE INVENTION

The present invention is, therefore, intended to supplement these shortcomings and provide a dial lock slide for slide fastener, which allows of alteration of the dial code at will to prevent an easy opening access of the lock.

With a view to achieve the above objectives the present invention is characterized by its specific construction, wherein a lock bar, which has a number of keys projected in a line on both sides of the outer surface, is provided at the end the lug of a slide; a cylinder, which has guide slits open on both sides so as to admit of the insertion of said keys above in them, is provided at the end of the lug of the slide on the other side; a number of locking devices, which are made by insertion of a lock ring with inner key grooves in a dial ring in a way that it can be fitted or removed at will, are provided so that said cylinder can be inserted in them as a whole keeping them rotatable at all times; and the end of said cylinder is inserted in a coupling ring intended for prevention of said locking devices from falling off.

By this construction, after rotating said locking devices so that slits on both sides of said cylinder and said inner key ring grooves may be joined together said lock bar is inserted in said cylinder, and when said locking devices are turned to certain degrees the slides on both sides will catch to lock.

Below, the present invention is described in further detail, references being made to the attached drawings as are required:

DETAILED DESCRIPTION OF THE INVENTION

Figure 1:
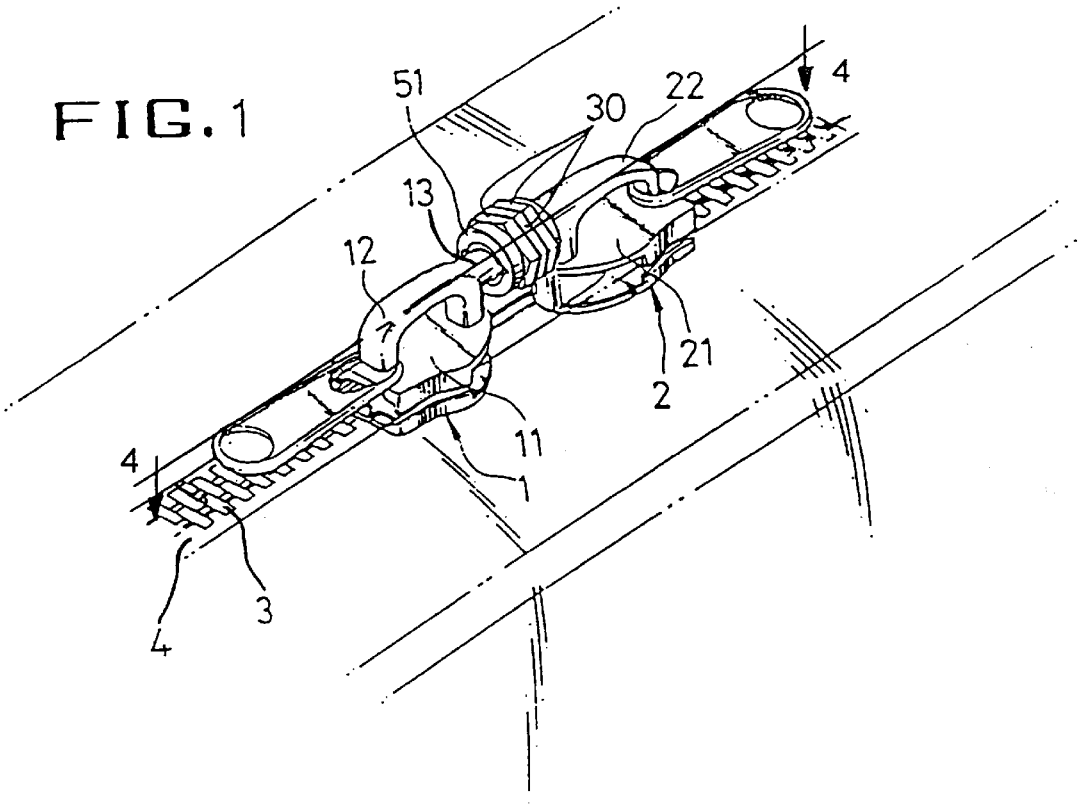
FIG. 1 is perspective view of the slide showing the present invention as it is in use.

FIG. one is a perspective view to show the present invention, which shows the slides 1, 2 on both sides positioned facing each other, which join a pair of rows of elements 3 together or separate them from each other by their sliding. The dial lock of the present invention comprises generally a male slide 1 and a female slide 2 which engage one another and are locked together by rotatable locking devices.

On the forward end of said lug 12 positioned on the upper surface of an upper wing 11 of said male slide 1 is said lock bar 13 positioned, projecting, which has a number of keys 14 (three each, here) aligned in the direction of an axis on both of the outer surface.

Meanwhile, on the front end of said lug 22 positioned on the surface of said upper wing 21 of said female slide 2 on the other side, as is seen in FIG. 3, is a cylinder 23 having guide slits 23*a* for keys 14 agape on both sides positioned, projecting, to receive to said lock bar 13 and a stopper 24 fixed on its one end.

Accordingly, keys 14 are guided by slits 23*a* said lock bar 13 can be inserted in said cylinder 23.

Figure 2:
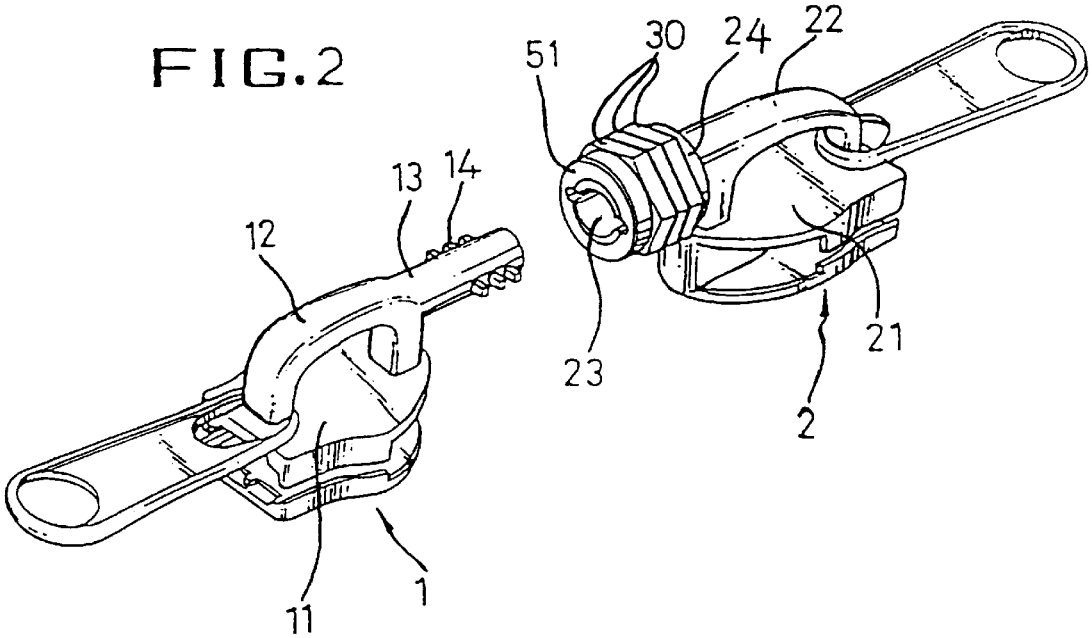
FIG. 2 is an exploded break-up perspective view of the present invention.
Figure 3A:
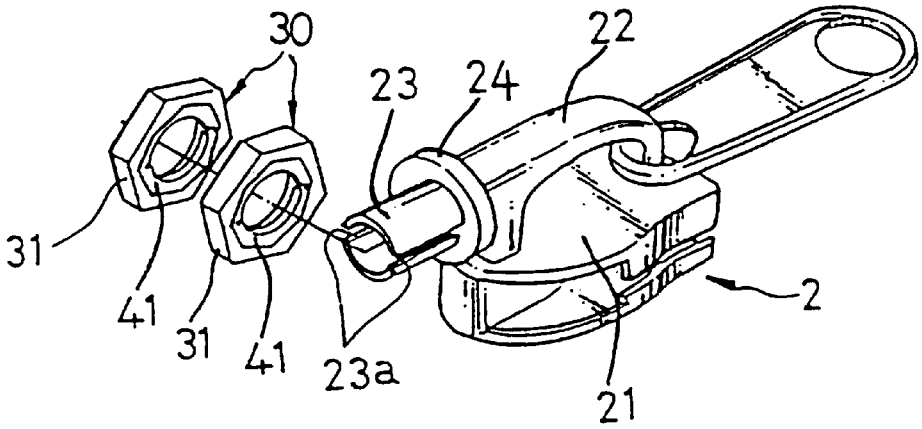
FIG. 3A is an exploded perspective view of the cylinder and two locking devices of the present invention.

Positioned around the outer surface of said cylinder 23 are a number of (three, here) locking devices 30 are fitted rotatably as seen in FIGS. 2 and 3A.

Figure 3B:
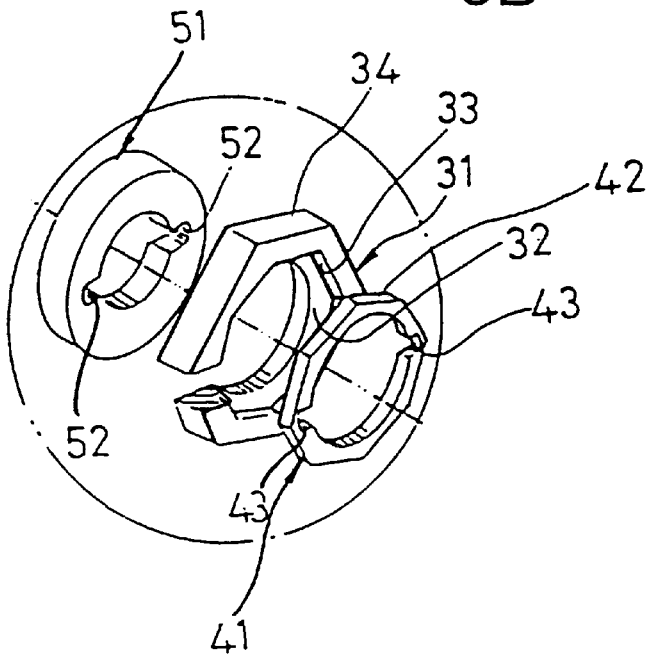
FIG. 3B is an enlarged exploded perspective view of a locking device and coupling ring of the present invention.

As seen in FIG. 3B, said locking devices 30 are constituted by both forming an inward-turning flange 32 on one side and inserting, rotatably, a lock ring 41, which has inner key grooves 43 for insertion of said key 14 formed on both sides of the inner surface corresponding to said slit 23*a* and also has a polygonal outer surface 42 corresponding to the inner surface 33 of said dial ring 31, in a dial 31 with its outer surface 33, 34 shaped in a polygon (preferably an equilateral polygon). The inner diameter and the thickness of said inward-turning flange 32 of said dial ring 31 are made just a little bit larger than the outer diameter and the thickness of said key 14.

And around the outer surface of the end of said cylinder 23, around which said locking devices 30 are fitted, a coupling ring 51 is fitted, to be removed at will, in order to keep said locking devices 30 from falling off said cylinder 23.

Said coupling ring 51 has inner key grooves 52 on both sides of its inner surface, said inner key grooves 52 being fitted to get through said slits 23*a*.

Around said outer surface 34 of each dial ring 31 are Arabic figures indicated.

Figure 4:
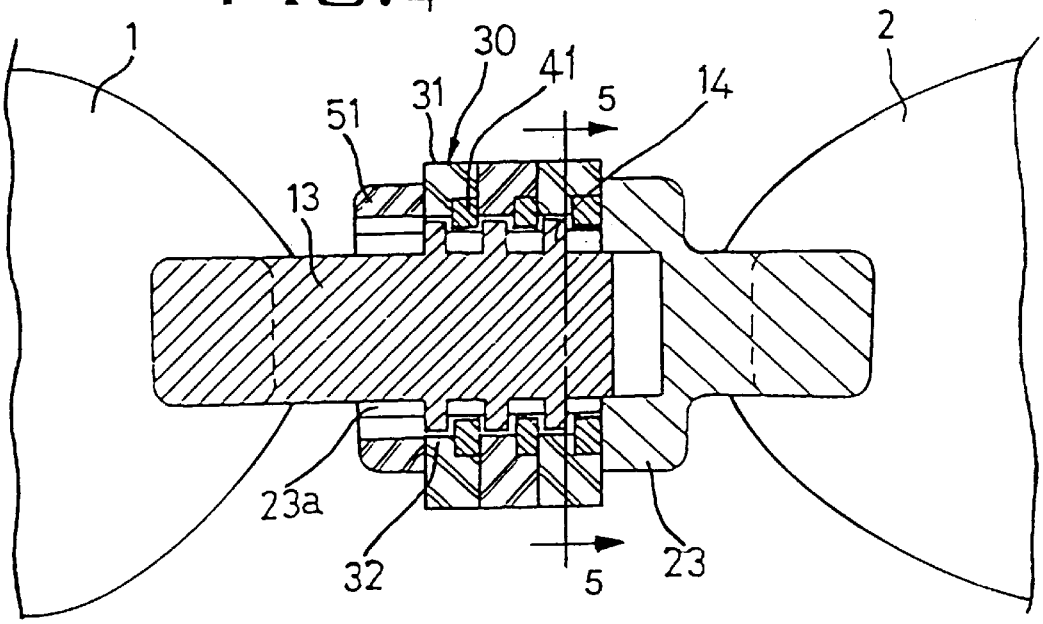
FIG. 4 is a sectional view of the slide as it is on the lock.
Figure 5:
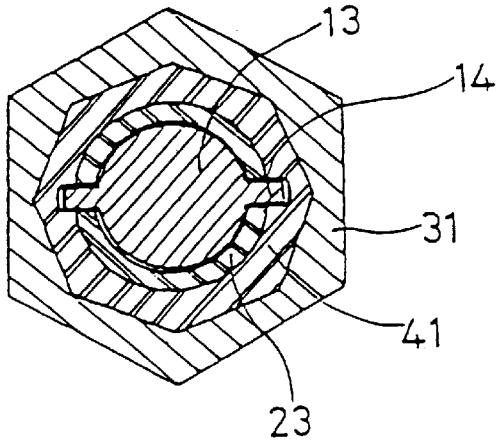
FIG. 5 is a sectional view of the slide showing the lock bar being inserted in the cylinder taken along lines 5—5 of FIG. 4.

Accordingly, when said lock bar 13 is inserted in said cylinder 23 while, as are shown in FIG. 5, said slit 23*a* of said cylinder 23, said inner key grooves 43 of each lock ring 41, and said inner key grooves 52 of said coupling ring 51 are connected through, then said keys 14, three each being formed on both sides of said lock bar 13, grooves 52, 43, stop in turn at possible corresponding to said inward-turning flange 32 of each dial ring 31, as is indicated in FIG. 4.

At this stage it is still possible to remove said lock bar 13 out of said cylinder 23, and so said locking devices 30 can be turned to whatever degrees at random, seeing the Arabic figures, namely, dial numbers (three-digits here) aligned on a side of said outer surface 34 of each dial ring 31. Then, afterwards, as the inner surface 33 of said dial ring 31 and the outer surface 42 of said lock ring 41 are both formed in equilateral polygons, and as said lock ring 41 turns together with said dial ring 31, the angles of said key 14 and said inner grooves 42 do not match, whereupon it becomes impossible to take said lock bar 13 out of said cylinder 23. That is, said slides 1, 2 are now on the lock.

In order to open the lock, it is required now to turn said inner locking devices 30 to match the remembered code, when said inner key grooves 43 of said lock ring 41 come in unison with said slits 23*a*, that is to a state given in FIG. 5, where it is possible to take said lock bar 13 from said cylinder 23.

In case the secret of a dial code gets disclosed to another person it is required to remove said lock ring 41 from said dial ring 31 after separating said coupling ring 51 and said locking devices 30 from said cylinder 23, then refit said lock ring 41 into said dial ring 31 corresponding with said inner key grooves 43 of said lock ring 41 show different figures from before. Now refitting said locking devices 30 and said coupling ring 51 to said cylinder 23 in the way given above and locking both sides 1, 2 will result in a different secret code to prevent theft.

Figure 6:
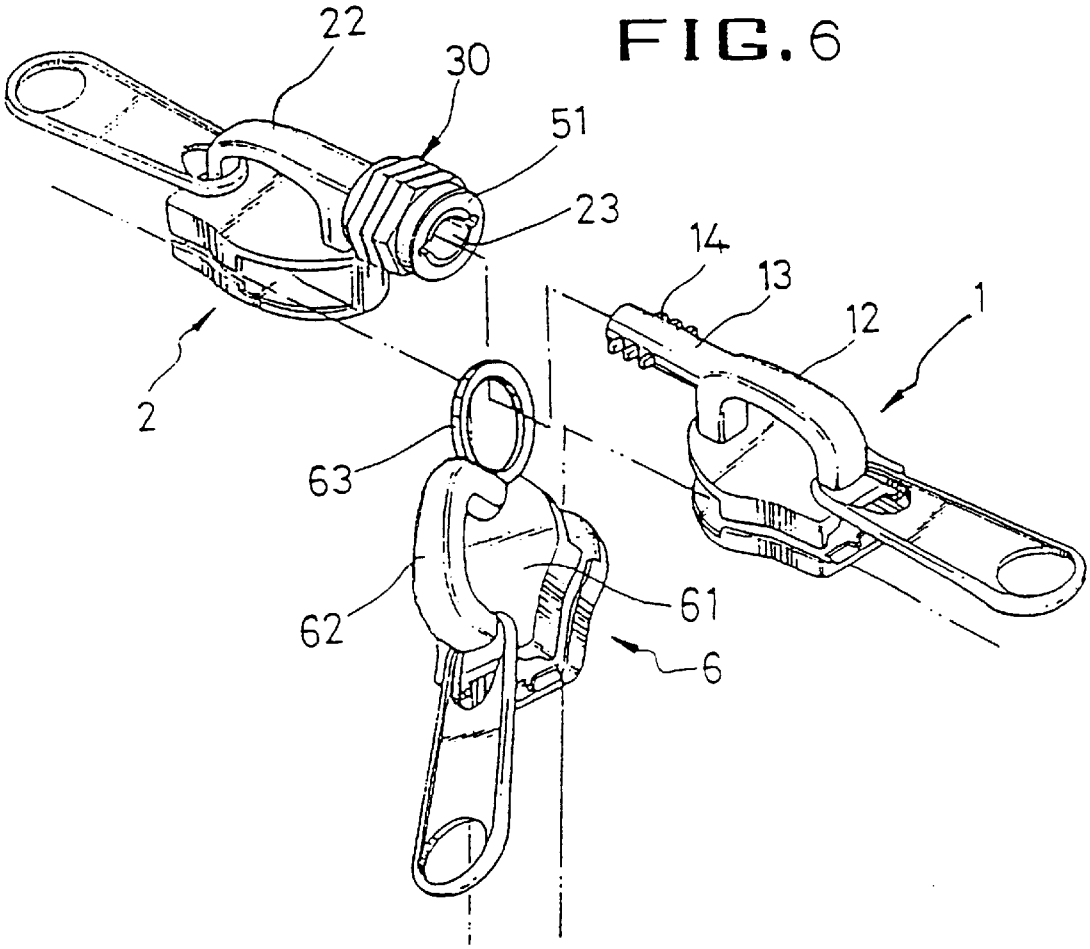
FIG. 6 is a perspective view showing another embodiment example of the preset invention.
Figure 7:
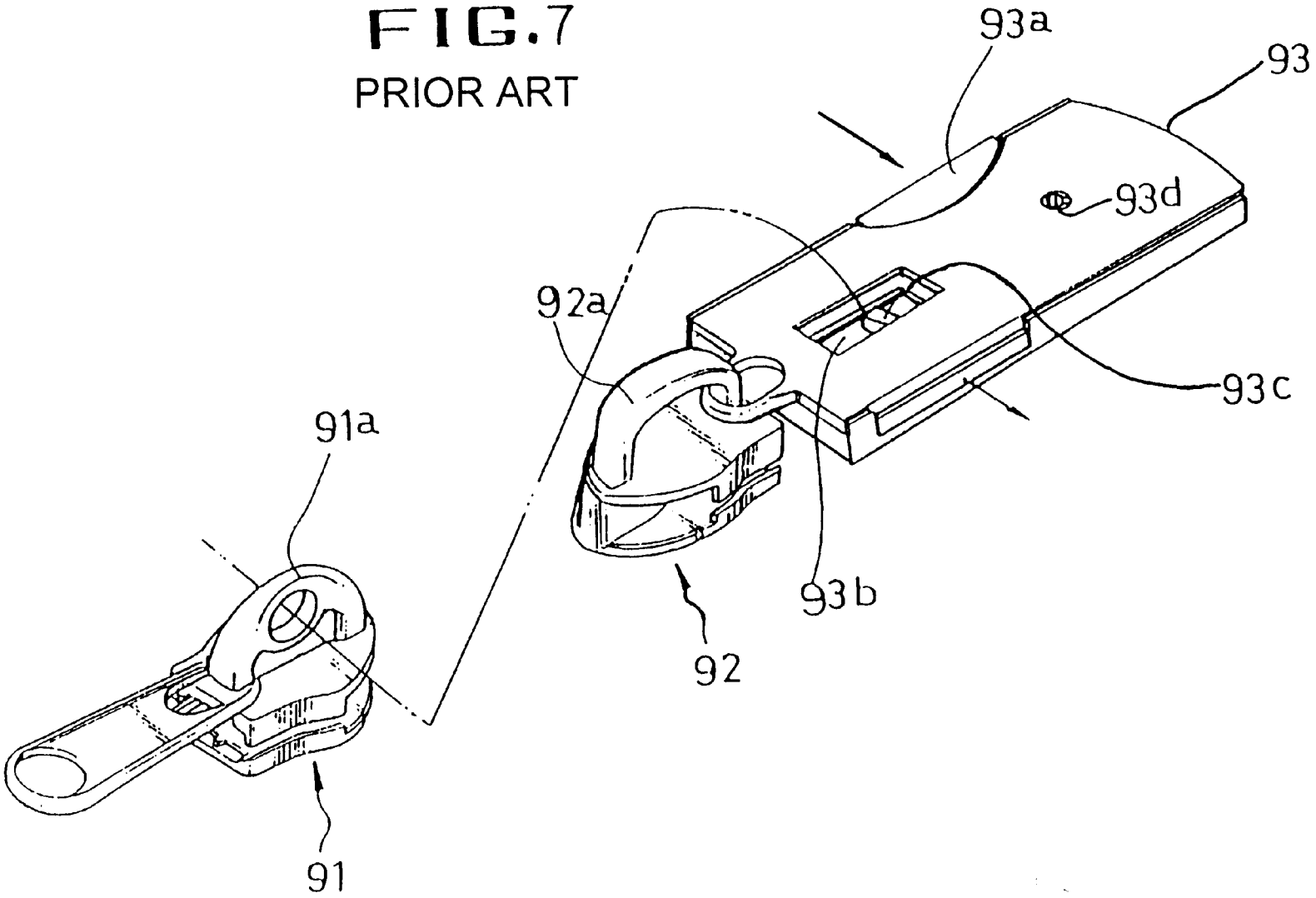
FIG. 7 PRIOR ART
FIG. 7 is a perspective view of a device of the prior art.

FIG. 6 is a perspective view of another example of embodiment, making it possible to lock said slides 1, 2 on both sides facing each other and another slides 6 directly crossing with them, all three together.

At the end of a lug 62 of an upper wing 61 of said slider 6, a ring 63 is formed perpendicularly.

Wherefore, it is possible to lock said three slides 1, 2, 3 with ease by inserting said lock bar 13 in said cylinder 23 of said slider 3 with said locking devices 30 and said coupling ring 51 fitted around it, as has been indicated above, after fully inserting said ring 63 in said lock bar 13 of said slide 1 before locking both slides 1, 2, and then by turning said locking devices 30 to whatever degrees at random.

As has been described above, in the present invention, a lock bar 13 is formed to a slide 1, one of the corresponding slides, and a cylinder 23 to another slide 2 at the other, while in the meantime it has been made possible to alter the dial code at will to prevent theft by means of constructing said lock devices 30 fitted to said cylinder 23 by inserting a lock ring 41 which has a polygonal outer surface 42 corresponding with said inner surface 33 in said dial ring 33 which has a polygonal inner surface 33, so as to be capable of removal at will.

Moreover, by means of forming said ring 63 to said third slide 3 which directly crosses with both of the corresponding slides 1, 2 it is made possible to lock even three slides 1, 2, 6 together with ease.

We claim:

1. A dial lock device for locking together at least two slides of a slide fastener, said dial lock device comprising:

a male portion comprising a lock bar having a longitudinal axis defining an engaging axis of said dial lock, said male member including a key protruding radially from said lock bar;

a female portion for receiving said male portion, said female portion comprising an inner cylinder having a guide slit for receiving said key, a locking device comprising a dial ring having a hexagonal outer surface for manipulating said dial ring and an odd-numbered-sided polygonal inner surface with an annular inward turning flange abutment and a lock ring having a correspondingly odd-numbered-sided polygonal outer surface received in said inner surface of said dial ring and abutting said inward turning flange, each side of said polygonal outer surface of said lock ring having a mating side on said polygonal inner surface of said dial ring so that each side of said lock ring outer surface engages a corresponding side of said dial ring inner surface such that said lock ring is completely surrounded by said dial ring on all sides for positive engagement of said lock ring therein, said lock ring also including an inner key groove for alignment with said guide slit; and a coupling ring having a key groove affixed to said female portion for retaining said dial ring on said inner cylinder, wherein alignment of said guide slit, said inner key groove and said key groove of said coupling ring enable insertion of said lock bar into said female portion and rotation of said dial ring locks said lock bar within said female portion.

2. The dial lock device of claim 1, wherein said lock bar further comprises a second key protruding radially from said lock bar in opposing relation to said first key and said female portion further comprises a second guide slit, a second inner key groove and a second key groove to align with one another and to receive said second key when aligned for more securely locking said lock bar within said female portion.

3. The dial lock device of claim 1, further comprising a plurality of keys spaced longitudinally along said lock bar of said male portion and a corresponding number of locking devices spaced longitudinally along said female portion for engaging said keys.

4. The dial lock device of claim 1, further comprising a locking ring of a third slide portion sized to receive said male portion and be retained between said male portion and said female portion when said locking device engages said key.

* * * * *